US006475402B2

(12) United States Patent
Nordstrom et al.

(10) Patent No.: US 6,475,402 B2
(45) Date of Patent: Nov. 5, 2002

(54) INK FEED CHANNELS AND HEATER SUPPORTS FOR THERMAL INK-JET PRINTHEAD

(75) Inventors: Terry V. Nordstrom, Corvallis, OR (US); Timothy R. Emery, Corvallis, OR (US); Sadiq Bengali, Corvallis, OR (US); Victorio A. Chavarria, Corvallis, OR (US); Michael G. Monroe, Corvallis, OR (US); George Radominski, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/798,477

(22) Filed: Mar. 2, 2001

(65) Prior Publication Data

US 2002/0122100 A1 Sep. 5, 2002

(51) Int. Cl.[7] ..... B41J 2/16

(52) U.S. Cl. ..... 216/27; 216/38; 216/39; 216/72; 216/79; 216/88

(58) Field of Search ..... 216/27, 38, 39, 216/72, 79, 88, 99

(56) References Cited

U.S. PATENT DOCUMENTS

| | | | | | |
|---|---|---|---|---|---|
| 5,278,584 | A | * | 1/1994 | Keefe et al. | 346/140 R |
| 5,635,966 | A | * | 6/1997 | Keefe et al. | 347/43 |
| 5,801,070 | A | * | 9/1998 | Zanini-Fisher et al. | 438/54 |
| 6,158,846 | A | * | 12/2000 | Kawamura | 347/65 |
| 6,279,402 | B1 | * | 8/2001 | Fisher | 73/754 |
| 6,309,054 | B1 | * | 10/2001 | Kawamura et al. | 347/65 |
| 6,322,201 | B1 | * | 11/2001 | Beatty et al. | 347/63 |

* cited by examiner

*Primary Examiner*—Anita Alanko

(57) ABSTRACT

An ink-jet printhead fabrication process and product that uses selectivity rate controlled etch techniques to produce trenches on the frontside of a silicon substrate to define ink feed channels and resistor support regions. Location and size of features is made independent of etch rate by providing a selective etch for the silicon trench etch steps that is greater than 10,000:1 for the silicon:oxide that defines ink feed channels and resistor support areas.

9 Claims, 6 Drawing Sheets

INK FEED CHANNELS AND HEATER SUPPORTS FOR THERMAL INK-JET PRINTHEAD

(2) CROSS-REFERENCE TO RELATED APPLICATIONS

Not Applicable.

(3) STATEMENT REGARDING FEDERALLY SPONSORED RESEARCH OR DEVELOPMENT

Not Applicable.

(4) REFERENCE TO AN APPENDIX

Not Applicable.

(5) BACKGROUND OF THE INVENTION

(5.1) Field of the Invention

The present invention relates generally to thermal ink-jet ("TIJ") technology and, more specifically, to a TIJ printhead structure and method of fabrication.

(5.2) Description of the Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic*] *Devices*, chapter 13(Ed. R. C. Durbeck and S. Sherr, Academic Press, San Diego, 1988).

A simplistic schematic of a swath-scanning inkjet pen 100 is shown in FIG. 1 (PRIOR ART). The body of the pen 101 generally contains an ink accumulator and regulator mechanism 102. The internal ink accumulator—or ink accumulation chamber—and associated regulator mechanism 102 are fluidically coupled 103 to an off-axis ink reservoir (not shown) in a known manner common to the state of the art. A printhead 104 element includes appropriate electrical connectors 105 (such as a tape automated bonding, "flex tape") for transmitting signals to and from the printhead. The printhead has columns of individual nozzles 106 forming an addressable firing array 107. The typical state of the art scanning pen printhead 104 may have two or more columns with more than one-hundred nozzles per column. The nozzle array 107 is usually subdivided into discrete subsets, known as "primitives," which are dedicated to firing droplets of specific colorants on demand. In a thermal ink-jet pen, an ink drop generator mechanism includes a heater resistor subjacent each nozzle 106 with an ink chamber therebetween. Selectively passing current through a resistor superheats ink to a cavitation point such that an ink bubble's expansion and collapse ejects a droplet from the associated nozzle 106.

Prior art for printhead structures and fabrication is typified by patents to Keefe et al., assigned to the common assignee herein. U.S. Pat. No. 5,278,584 shows an IMPROVED INK DELIVERY SYSTEM FOR AN INK-JET PRINTHEAD. U.S. Pat. No. 5,635,966, a continuation in part of the Keefe '584 patent, shows an EDGE FEED INK DELIVERY THERMAL INKJET PRINTHEAD STRUCTURE AND METHOD OF FABRICATION.

The ever increasing complexity and miniaturization of TIJ nozzle arrays has led to the use of silicon wafer integrated circuit technology for the fabrication of printhead structures. For the purpose of the present invention, the "frontside" of a silicon wafer, or wafer printhead die region, is that side having drop generator elements; the "backside" of a silicon wafer, or wafer printhead die region, is that the opposite planar side, having ink feed channels (also referred to simply as "trenches") fluidically coupled by ink feed holes through the silicon wafer to the drop generator elements.

In general, prior solutions to problems of working in silicon wafer technology to fabricate ink-jet printheads have taken two general forms. The first is to use a thin oxide membrane to define ink feed holes and provide a structural support for the associated resistor heaters. This technique has problems with the thin oxide breaking or distorting or both. A second solution relies upon an inherent slower etch rate of boron doped silicon in the etch processes used for defining a backside trench; the silicon under the resistor is heavily doped with boron to a depth of five to ten microns, masking the positions of the ink feed holes and leaving those feed hole regions undoped, thereby establishing different etch rate regions of the substrate. There appears to still be a lack of consistency in the etch rate of the boron-doped silicon; undercutting of the silicon at oxide interfaces occurs.

There is a need to provide an improved support structure under TIJ ink droplet firing resistors and to provide improved structural stability for TIJ ink feed channels.

(6) BRIEF SUMMARY OF THE INVENTION

In its basic aspect, the present invention provides an ink-jet printhead fabrication process using a silicon wafer, the process including: on a first surface of the wafer, forming an array of ink-jet drop generator location trenches interspersed with ink feed hole barrier trenches; filling said trenches with at least one material having a substantially equal or greater load bearing characteristic than silicon; and forming drop generator heater elements superjacent said inkjet drop generator location trenches and ink feed holes leading from a second surface of the wafer to said first surface between said ink-jet drop generator location trenches and adjacent barrier trenches.

In another aspect, the present invention provides a thermal ink-jet printhead device including: a silicon substrate having a first surface; a plurality of ink heaters; and a support subjacent each of said heaters embedded in said first surface, said support being a material having a load bearing characteristic equal to or greater than that of said silicon substrate.

In still another aspect, the present invention provides a thermal ink-jet pen, including: a body; an ink accumulation chamber within said body; and a printhead having a plurality of ink firing nozzles in a predetermined array, wherein each of said nozzles has an associated ink heater mounted on a silicon substrate printhead structure, each heater has at least one associated ink feed hole adjacent thereto and in fluidic communication with said ink accumulation chamber, and each said heater has a printhead structure support of a material having a substantially equal or greater load bearing characteristic than the silicon substrate load bearing characteristic, and each ink feed hole having inner sidewalls formed by said printhead structure support and outer sidewalls formed by an ink feed hole support formed of said material.

Some of the advantages of the process in accordance with the present invention are: it provides a three-dimensional control for forming ink feed holes and membrane dimensions measurable and verifiable early in the wafer fabrication process; it allows wider architectural design options to solve fluid dynamics problems associated with ink-jet printheads; it provides accurate wafer frontside alignment of ink feed channels and drop generator firing resistors; and it decreases technological demands with respect to architecture tolerances.

Some advantages of the employment of this process with respect to printheads fabricated therewith are: ink-jet printhead properties that define fluidics are set and verified early in the printhead fabrication process; a high firing frequency is attainable; increased nozzle-packing density is attainable; it provides for the incorporation of more intricate features such as particle filters; smaller nozzle sizes with concomitant ink drop volume reduction are attainable; and it provides wider design flexibility with respect to a ink viscosity.

The foregoing summary is not intended to be an inclusive list of all the aspects, objects, advantages, and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Objects, features and advantages of the present invention will become apparent upon consideration of the following explanation and the accompanying drawings, in which like reference designations represent like features throughout the drawings.

(7) BRIEF DESCRIPTION OF THE DRAWINGS

The drawings referred to in this specification should be understood as not being drawn to scale except if specifically annotated.

(8) DETAILED DESCRIPTION OF THE INVENTION

Reference is made now in detail to a specific embodiment of the present invention, which illustrates the best mode presently contemplated by the inventors for practicing the invention. Alternative embodiments are also briefly described as applicable. In general, in accordance with the present silicon wafers are patterned and etched in the regions where improved membrane support for resistors and improved ink feed holes are desired.

Figure 1:
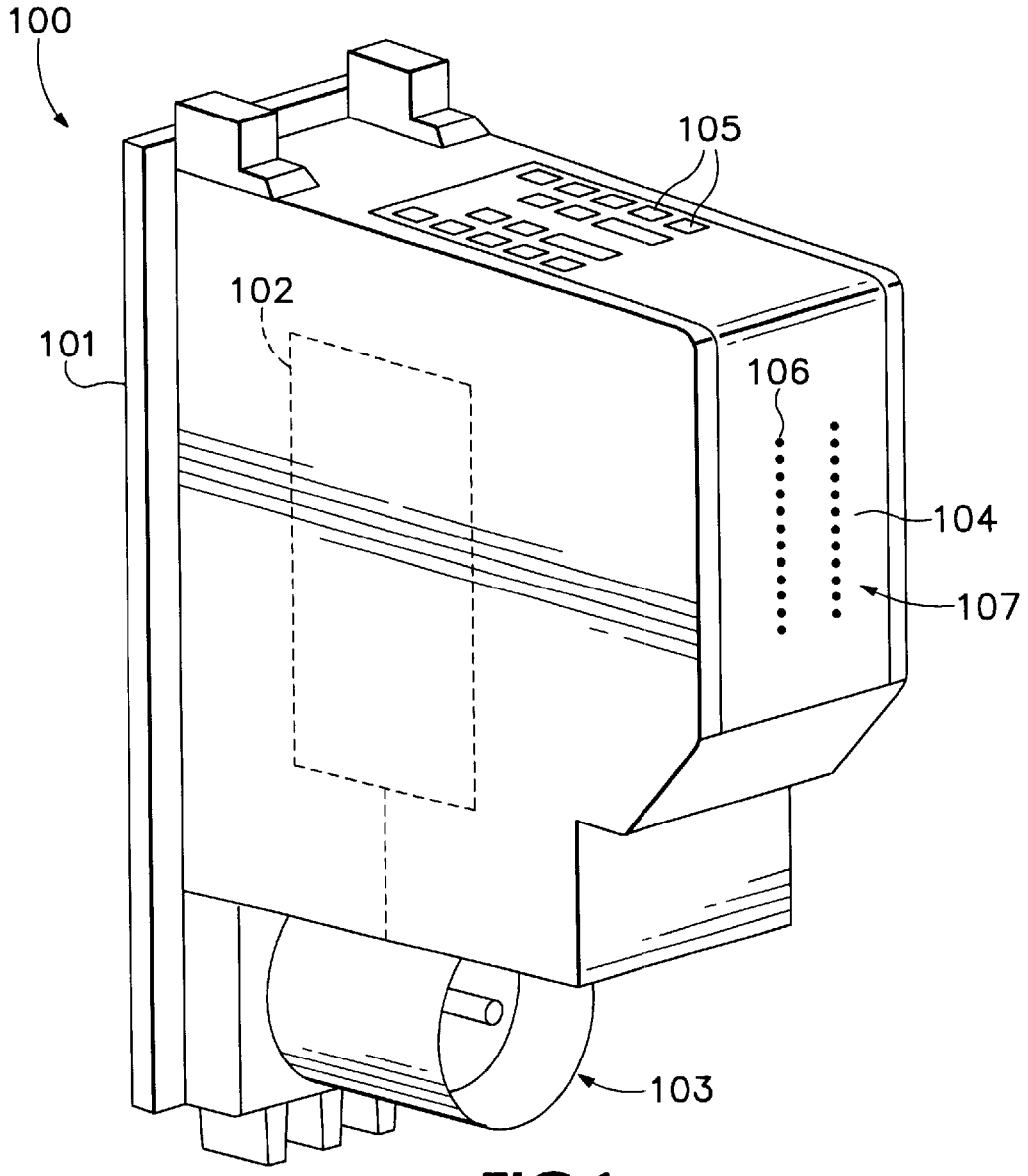
FIG.1 (PRIOR ART)
FIG. 1 (Prior Art) is a schema tic illustration in perspective view of an ink-jet pen.
Figure 2:
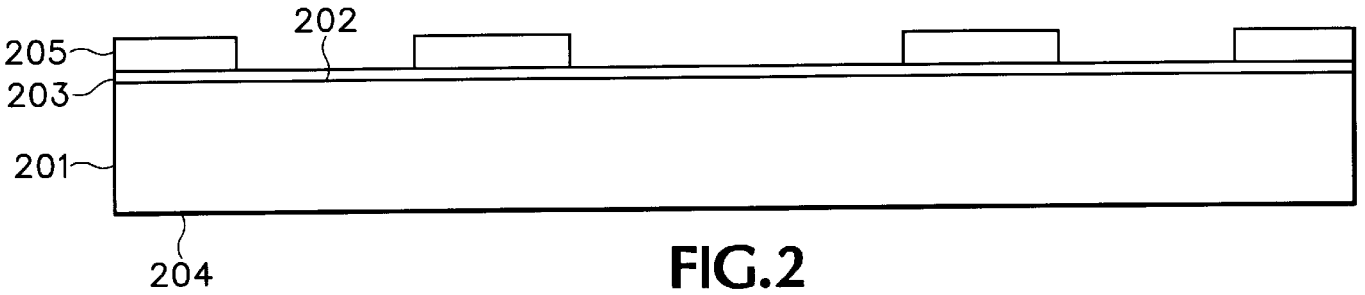
FIGS. 2 through 2G are schematic illustrations of the step of a process in accordance with the present invention.

The process in accordance with the present invention is now described with reference to FIGS. 2–2G. It should be recognized that these illustrations are schematics for a very small region of a silicon wafer which may be many orders of magnitude greater in dimension to the shown die region. Many publications describe the details of common techniques used in the fabrication of complex, three-dimensional, silicon wafer based structures; see e.g., *Silicon Processes,* Vol. 1–3, copyright 1995, Lattice Press, Lattice Semiconductor Corporation (assignee herein), Hillsboro, Oreg. Moreover, the individual steps of such a process can be performed using commercially available fabrication machines. The use of such machines and common fabrication step techniques will be referred to hereinafter as simply: "in a known manner." As specifically helpful to an understanding of the present invention, approximate technical data are disclosed herein based upon current technology; future developments in this art may call for appropriate adjustments as would be apparent to one skilled in the art. FIG. 3 is a flow chart tracking the steps of the fabrication process and is referred to hereinafter in conjunction with FIGS. 2–2G.

Referring also now to FIG. 3, the process starts with a commercially available silicon wafer 201 as a substrate. The wafer 201 has a frontside surface 202 and a backside surface 204.

A frontside oxide 203 layer, also referred to as a "blocking oxide," having a thickness of about 1500 Angstroms (Å) is grown in a known manner on the frontside of wafer—step 302. The thickness of the oxide 203 will be dependent upon the implementation specific etch process following. In general, it may be as thick as 10,000 Å or as thin as 100 Å.

A photoresist 205 layer is formed superjacent the oxide 203 in a known manner. Known manner photolithography processes are used to selectively remove regions of the photoresist 205, forming a mask having a pattern associated with forming printhead resistor platforms and interspersed ink feed holes—step 304. In other words, the blocking oxide 203 is patterned using a mask that defines ink feed hole regions and the boundaries of frontside trenches where resistors will be formed in later process steps.

Figure 2A:
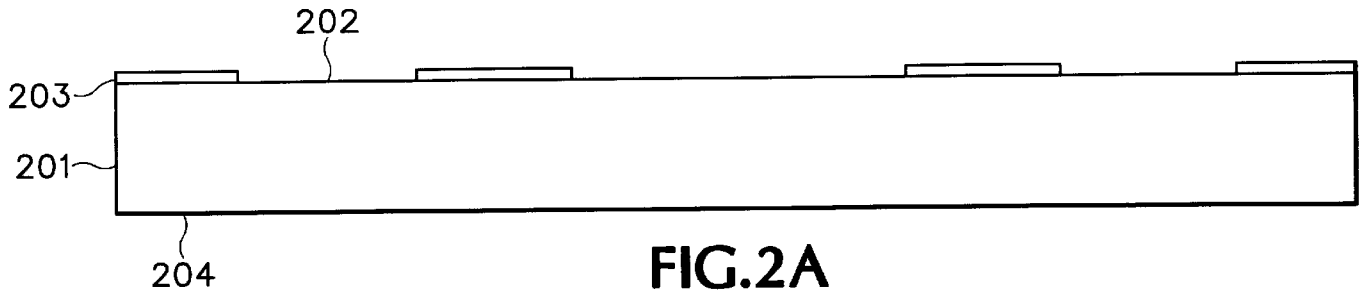

An etch process is used on the photoresist 205 and subjacent oxide 203—step 305—to expose the frontside surface 202 and yet-to-be-formed etched trench regions of the silicon wafer 201. The photoresist 205 is then stripped using known manner techniques leaving the structure as shown in FIG. 2A.

Figure 2B:
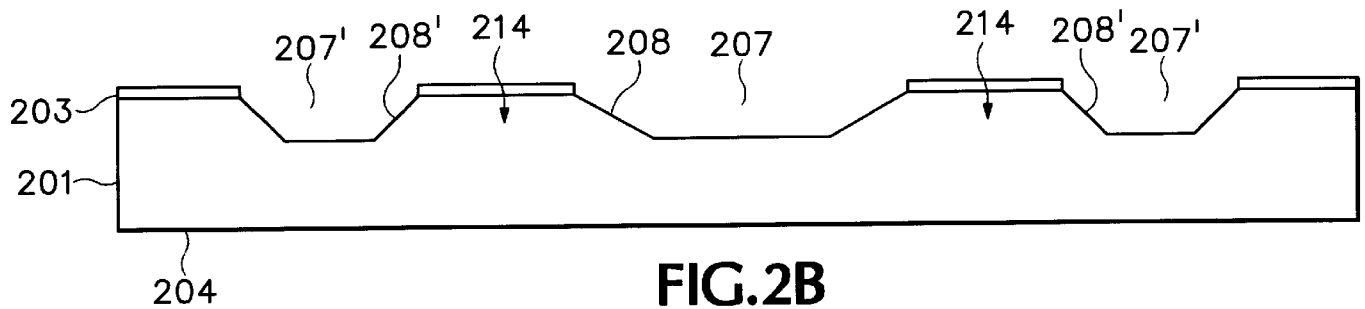

Next, step 306, trenches 207, 207' are etched in the frontside surface 202 of the wafer 201. In the preferred embodiment, the etched trenches 207, 207' have a depth from the frontside surface 202 in the range of approximately one micron to twenty microns, and preferably at least five microns. As illustrated by FIG. 2B, the trenches 207, 207' are formed in predetermined array patterns such that yet-to-be-formed resistor location trenches 207 are interspersed with areas 214 that will be sites for yet-to-be-formed ink feed holes (note that other TIJ printhead device may alternatively be located accordingly). Backside trench sidewalls will terminate in adjacent trench regions 207'.

Known micro-machining silicon wet etch process can be employed to define the trenches 207, 207'. For example, tetramethyl ammonium hydroxide ("TMAH") or KOHIIPA processes can be employed. With a 1500 Å (±250 Å) blocking oxide 203, a KOH/IPA process, 2:2:1 ratio of KOH (45%):DI $H_2O$:IPA, at 50° C. will etch silicon at 1000–1200 Å/minute. This same process etches oxide at 2.0 Å-to-5.0 Å/minute at 20° C.-to-50° C. and provides sufficient process margins. It has been found that lower temperatures slows the etch rate for control at a cost of selectivity; specific implementations should take this into consideration. Trench depth can be measured using a profilometer.

Figure 4:
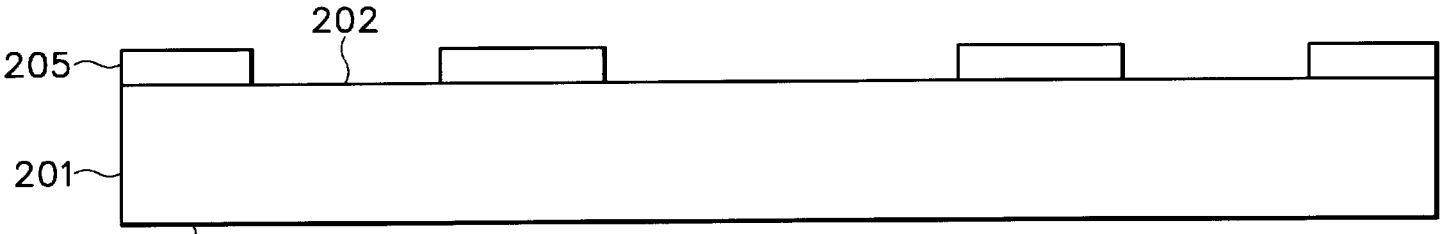
FIGS. 4 through 4B are schematic illustrations of alternative embodiments of certain steps of the process as shown in FIGS. 2–2C.
Figure 4A:
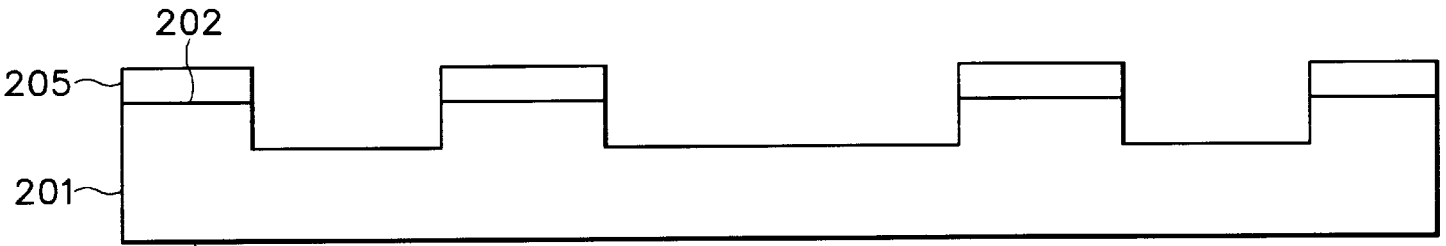

Preferably, a dry etch process, using known manner chemistry and etch tools, is employed as it allows better dimensional control. Turning to FIG. 4, a dry etch process allows patterning directly on the wafer 201 frontside surface 202 without first growing a blocking oxide; a photoresist mask 205 is formed directly on the frontside surface. However, note that as with the process steps as shown so far in FIGS. 2–2B, it may still be desirable to use a blocking oxide as part of the mask if silicon contamination problems are a concern. A known manner of fluorine or chlorine based dry etch process can be employed; each has a resist:silicon selectivity of about 1:15 to 1:100. Comparing FIG. 2B and FIG. 4A, the better dimensional control of dry etch is depicted by using squared analogous features in FIGS. 4A and 4B.

This first trench mask is then removed by a known manner process—step 308. Note that an option is to etch only partially any remaining blocking oxide 203 or partially etch the blocking oxide to trim away any overhang above the trenches 207, 207'; the choice will be determined primarily by the selectivity of subsequent chemical mechanical polishing (CMP) processes, infra (viz., less selectivity in the CMP would dictate doing only a partial oxide strip so as to provide a thicker surface 202 oxide following trench oxide formation, infra).

Figure 2C:
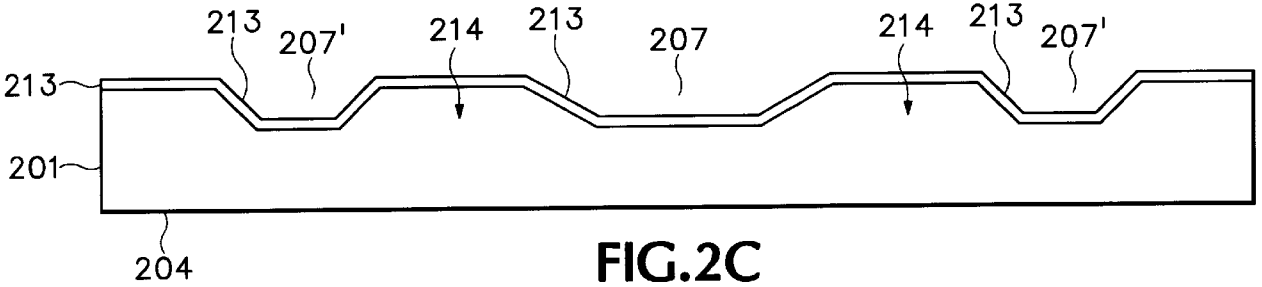
Figure 4B:
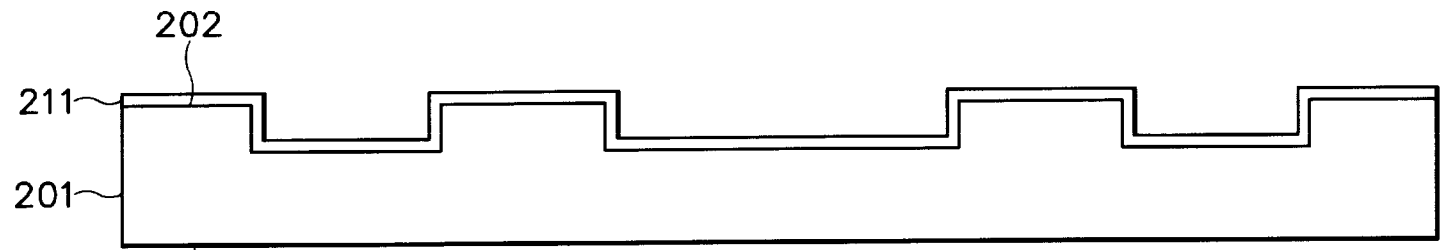

Turning now to FIGS. 2C and 4B, an etch barrier, trench oxide 213 layer is grown in a known manner—step 310 (note that from this point on in the process, other than for the "square" vs. "sloped" look to the illustrations, the basic steps and device structure are the same with respect to the dry etch embodiments described). In the preferred embodiment, the etch barrier trench oxide 213 layer has a thickness of approximately 2500 Å (±1000 Å); more generally, in an approximate range of 200 Å to 10000 Å.

Figure 2D:
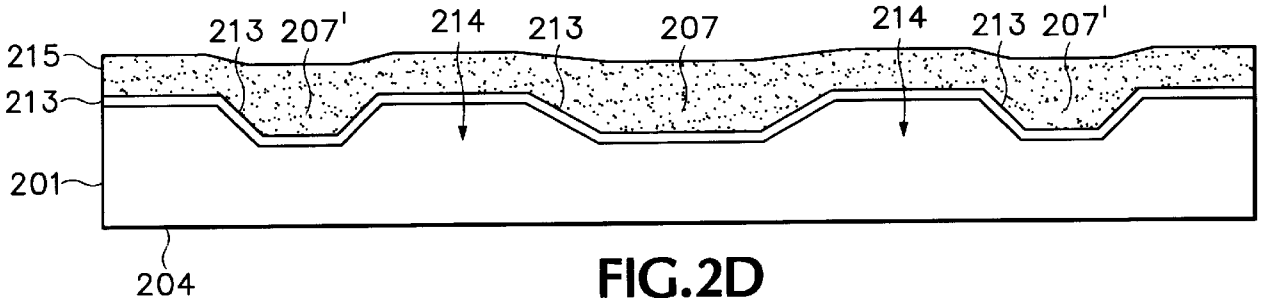

Next, as shown in FIG. 2D, a polysilicon film 215 is formed in a known manner (e.g., in an epitaxial reactor) on the frontside surface of the substrate 201—step 312. The polysilicon film 215 will later serve as the support membrane under the firing resistor. The polysilicon film 215 should have a thickness in the range of approximately 2.5 to 10 microns above the surface of the islands; in the preferred implementation, the thickness of the polysilicon film 215 is greater than the trench depth. Note that the depth of the trenches 207, 207' thickness of the polysilicon support 223, 223' can be modulated to accommodate ink-jet printhead designs that require different printing speeds and ink drop sizes.

Figure 2E:
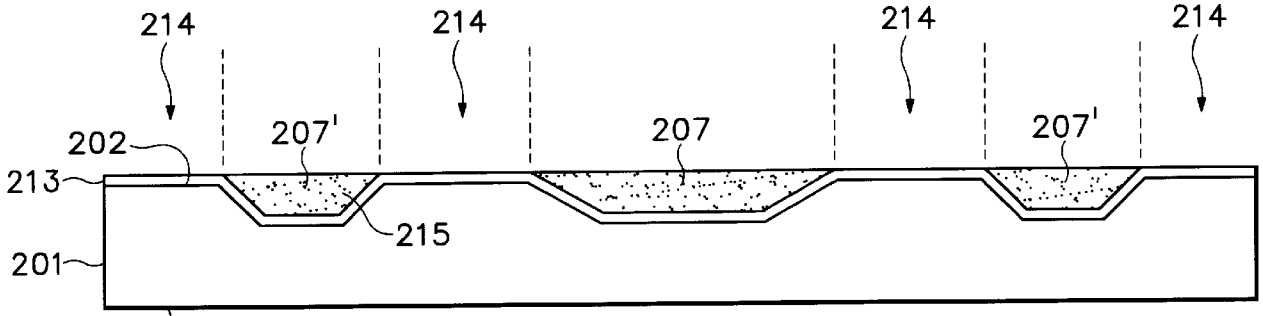

Next, as depicted by FIG. 2E, a known manner CMP process is used to reduce the polysilicon film 215 layer back, stopping at the surface of the trench oxide 213 layer and leaving a substantially flat surface for future resistors to be formed on—step 314. The CMP process should have a high selectivity polysilicon:oxide ratio in order to prevent over polishing of the polysilicon 215 and trench oxide 213. For example, known manner CMP processes (e.g., polysilicon polishing slurry known as Semi-Sperse P1000™, from Cabot company) have an ability to polish polysilicon at 1 um/min with a selectivity to oxide of over 1000:1. Thus, precise control of the to-be-formed ink feed hole location and shape can be executed.

The etch oxide 213 is stripped from the islands 214 in a known manner—step 314 (e.g., an oxide:silicon 10:1 HF wet etch). A substantially flat frontside surface 217 will now exist, namely, the frontside surfaces of the polysilicon 215 filled trench regions 207, 207' and intervening islands of silicon wafer surface 202.

Figure 2F:
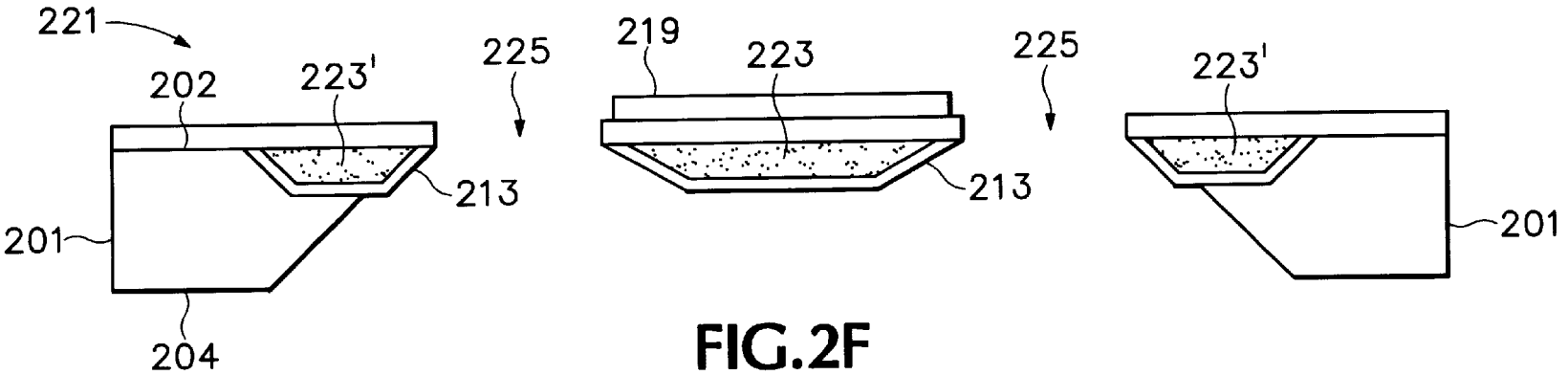

The resulting structure is a construction that is ready for the formation of the drop generators and backside ink channels of the TIJ printhead—step 318. Those steps are known in the art, exemplified by the Keefe et al. patents, supra, incorporated herein by reference in their entirety. As shown in FIG. 2F, after a known manner (e.g., silicon:oxide 12000:1 TMAH) backside silicon masked etch defining ink feed holes 225, a resulting structure 221, having a known manner formed drop generator resistor 219 and ink-jet barrier layer 220, has the foregoing process provided polysilicon support regions 223, 223' for both the resistor and ink feed hole 225 sidewalls.

Figure 2G:
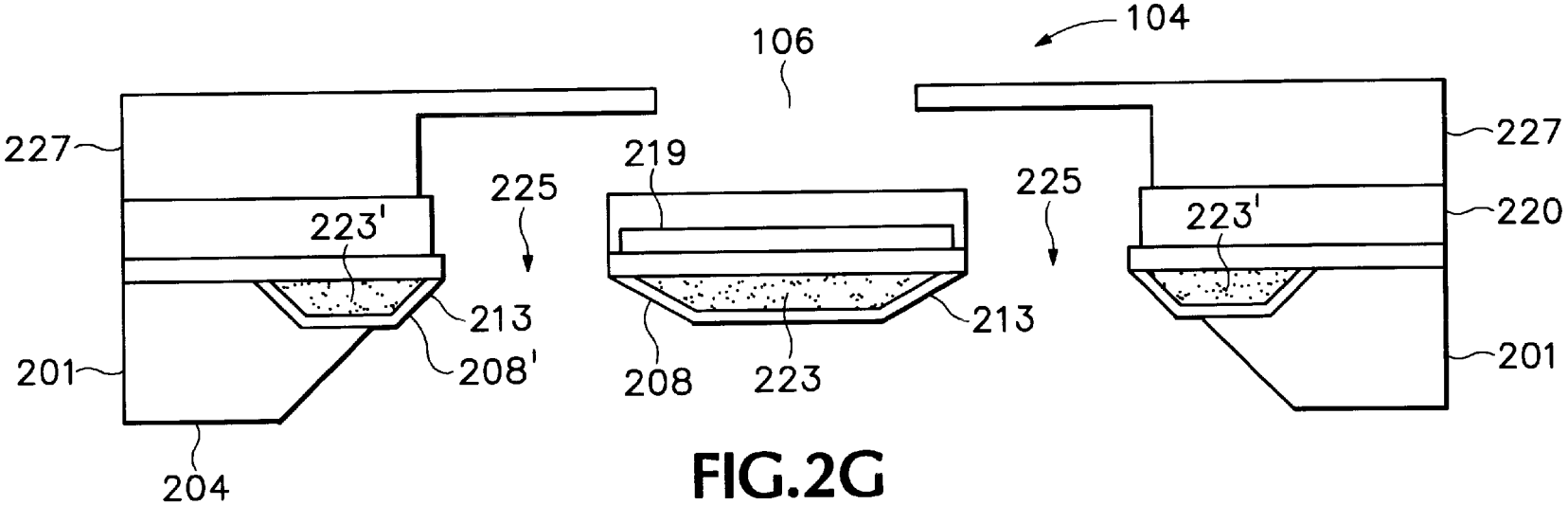
Figure 3:
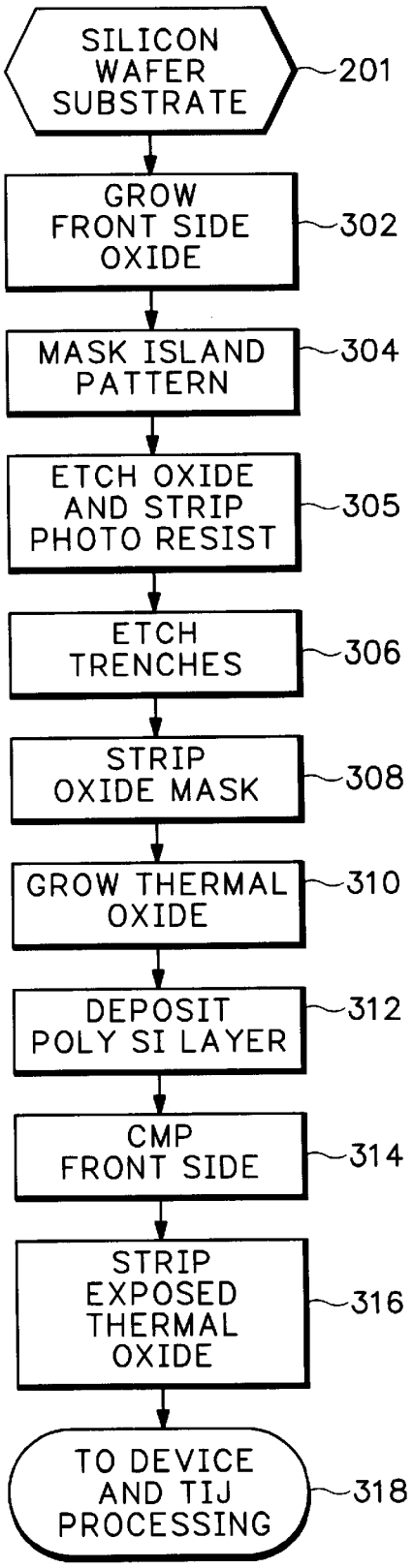
FIG. 3 is a flow chart of the process in accordance with the present invention as shown in FIGS. 2–2G.

An orifice plate 227 overlay, having ink droplet firing nozzles 106, completes the drop generator/nozzle array structure as illustrated by FIG. 2G.

The process in accordance with the present invention provides major advantages: (1) location of the ink feed holes from the backside to the drop generator ink chambers is defined by lithography on the frontside of the wafer, allowing much tighter tolerances for critical printhead features; thus, nozzle packing density can be improved, fluidic characteristics are set at the beginning of the fabrication process, and ink feed hole sidewall positions are more predictable, (2) the use 10,000:1 etch selectivity between the silicon to silicon oxide results in precise control of ink feed hole location and shape, (3) the polysilicon support regions, having inherently greater structural stability than thin oxides used in the prior art beneath the resistors, provides improved structural stability, substantially eliminating prior art solution problems regarding deformation and cracking, and (4) polysilicon supports provide better heat dissipation properties than prior art thin oxides.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . " and no process step herein is to be construed under those provisions unless the step or steps are expressly recited using the phrase "comprising the step(s) of . . . "

What is claimed is:

1. An ink-jet printhead fabrication process using a silicon wafer, the process comprising:

on a first surface of the wafer, forming an array of ink-jet drop generator location trenches interspersed with ink feed hole barrier trenches;

filling said trenches with at least one material;

forming drop generator heater elements superjacent said ink-jet drop generator location trenches, said drop generator heater elements being supported by said at least one material in said ink-jet drop generator location trenches; and forming ink feed holes leading from a second surface of the wafer to said first surface between said ink-jet drop generator location trenches and adjacent barrier trenches.

2. The process as set forth in claim 1 wherein said material has a substantially equal or greater heat dissipation characteristic than silicon.

3. The process as set forth in claim 1, the step of forming said trenches further comprising:

etching the trenches into said first surface in a wet etch process having a selectivity between silicon and silicon oxide in the approximate ratio of 10,000:1.

4. The process as set forth in claim 1, the step of forming said trenches further comprising:

etching the trenches into said first surface in a dry etch process having a selectivity between silicon and silicon oxide in the approximate ratio 10,000:1.

5. The process as set forth in claim 1, the step of filling said trenches further comprising:

forming an oxide layer covering a bottom inner surface and sidewall inner surface of said trenches.

6. The process as set forth in claim 5, further comprising:

forming a polysilicon layer covering said oxide layer.

7. The process as set forth in claim 1 wherein said material has a thickness greater than a maximum trench depth.

8. The process as set forth in claim 7, the step of filling further comprising:

performing a chemical mechanical polish of said polysilicon layer to an extent such that following said polish, said trenches remain filled with polysilicon on thermal oxide.

9. The process as set forth in claim 8, wherein performing a chemical mechanical polish further comprises:

polishing until the first surface of said wafer between said trenches is exposed.

* * * * *